US009697712B2

(12) United States Patent
Eyring et al.

(10) Patent No.: US 9,697,712 B2
(45) Date of Patent: Jul. 4, 2017

(54) SMART DETECTION

(71) Applicant: Vivint, Inc., Provo, UT (US)

(72) Inventors: Matthew J. Eyring, Provo, UT (US); Jeremy B. Warren, Draper, UT (US); James E. Nye, Alpine, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 14/749,246

(22) Filed: Jun. 24, 2015

(65) Prior Publication Data

US 2016/0379458 A1 Dec. 29, 2016

(51) Int. Cl.

| | |
|---|---|
| ***G08B 13/24*** | (2006.01) |
| ***G08B 3/10*** | (2006.01) |
| ***G08B 5/36*** | (2006.01) |

(52) U.S. Cl.

CPC ..... *G08B 13/2491* (2013.01); *G08B 3/10* (2013.01); *G08B 5/36* (2013.01)

(58) Field of Classification Search

CPC .. H04L 63/0861; G08B 13/2491; G06F 21/31
See application file for complete search history.

(56) References Cited

U.S. PATENT DOCUMENTS

| | | | | |
|---|---|---|---|---|
| 6,950,725 | B2 | 9/2005 | von Kannewurff et al. | |
| 7,911,341 | B2 | 3/2011 | Raji et al. | |
| 2010/0289643 | A1* | 11/2010 | Trundle | F24F 11/0086 340/545.1 |
| 2011/0009097 | A1* | 1/2011 | Sweeney | H04W 24/02 455/414.1 |
| 2012/0092163 | A1* | 4/2012 | Hart | G08B 19/005 340/541 |
| 2014/0089673 | A1* | 3/2014 | Luna | H04L 63/0861 713/186 |
| 2014/0266669 | A1 | 9/2014 | Fadell et al. | |
| 2015/0154850 | A1* | 6/2015 | Fadell | G06Q 10/083 340/501 |

FOREIGN PATENT DOCUMENTS

| | | |
|---|---|---|
| CN | 103581311 | 2/2014 |

OTHER PUBLICATIONS

English machine translation of the specification,claims and abstract of CN103581311. Feb. 12, 2014.
Huang et al., Homelog based kid's activity awareness, Computation World: Future Computing, Service Computation, Cognitive, Adaptive, Content, Patterns, 2009.

* cited by examiner

*Primary Examiner* — Nabil Syed
(74) *Attorney, Agent, or Firm* — Holland & Hart, LLP

(57) ABSTRACT

Security and/or automation systems, collectively referred to as automation systems, may allow a parent to leave their child at home and feel comfortable. The automation system may receive a notification that the parents are leaving. The parents may set a child alone state or a babysitter state. The system may use settings determined by the parents to track child parameters. Restricted areas may include a parents liquor cabinet, a parents bedroom, an office, and the like. The automation system may additionally track the comings and goings of a child to determine if the child is out past a curfew, when the child left, when the child arrived at home, and the like. Additionally, the parent away state may implement a lock down on any firearms or other potential hazards in a home.

23 Claims, 8 Drawing Sheets

SMART DETECTION

BACKGROUND

The present disclosure, for example, relates to security and/or automation systems, and more particularly to tracking the arrival of a person to a residence and positively identifying the person based on behavioral patterns.

Security and automation systems are widely deployed to provide various types of communication and functional features such as monitoring, communication, notification, and/or others. These systems may be capable of supporting communication with a user through a communication connection or a system management action.

Parents may wish to track the comings and goings of their children while they are not at their residence. This may allow working parents to confirm their children are conforming with desired behavioral expectations. Additionally, parents may wish to know when select people have entered a home to ensure the home is a safe place for their children and that illicit people have not entered the premises.

SUMMARY

In some embodiments, security and/or automation systems, collectively referred to as automation systems, may allow a parent to leave their child at home and feel comfortable. The automation system may receive a notification that the parents are leaving. The parents may set a child alone state or a babysitter state. Once a state is set, the system may use settings determined by the parents to track one or more child parameters. The child parameters may include tracking visitors to a house, tracking medical parameters, a lights-out provision, a lock on restricted areas of the home, a wake up state, and the like. Restricted areas may include a parents liquor cabinet, a parents bedroom, an office, and the like. The automation system may additionally track the comings and goings of a child to determine if the child is out past a curfew, when the child left, when the child arrived at home, and the like. Additionally, the parent away state may implement a lock down on any firearms or other potential hazards in a home.

In one embodiment, a method for security and/or automation systems is described. The method may include detecting an entry of a first person into a residence, tracking actions of the first person after the detected entry to the residence, comparing the tracked actions of the first person to a set of predetermined profiles, and determining an identity of the first person based at least in part on the comparing.

In another embodiment, the method may include tracking actions of the first person to develop a predetermined profile associated with the first person. The method may confirm the identity of the first person. In some instances, the method may include notifying a second person of the confirmed identity of the first person. The first person may be a minor and the second person may be an adult. The method may include confirming the identity of the first person via at least a biometric feature, a unique mobile device detection, a unique entry code, or a combination thereof.

In some instances, the method may activate a first alarm state of the automation system based at least in part on the confirmed identify of the first person. The method may also detect the first person exiting the residence and notifying a second person of the detected exit after a predetermined time period. The first person may not reenter the residence within the predetermined time period. The method may identify a user pattern of behavior of the first person based at least in part on time of day and the tracked actions of the first person. The pattern of behavior may be different based at least in part on the time of day.

In another embodiment, an apparatus for security and/or automation systems is described. The apparatus may include a processor, memory in electronic communication with the processor, and instructions stored in the memory. The instructions may be executable by the processor to detect an entry of a first person into a residence, track actions of the first person after the detected entry to the residence, compare the tracked actions of the first person to a set of predetermined profiles, and determine an identity of the first person based at least in part on the comparing.

In another embodiment, a non-transitory computer-readable medium storing computer-executable code is described. The code may be executable by a processor to detect an entry of a first person into a residence, track actions of the first person after the detected entry to the residence, compare the tracked actions of the first person to a set of predetermined profiles, and determine an identity of the first person based at least in part on the comparing.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Figure 1:
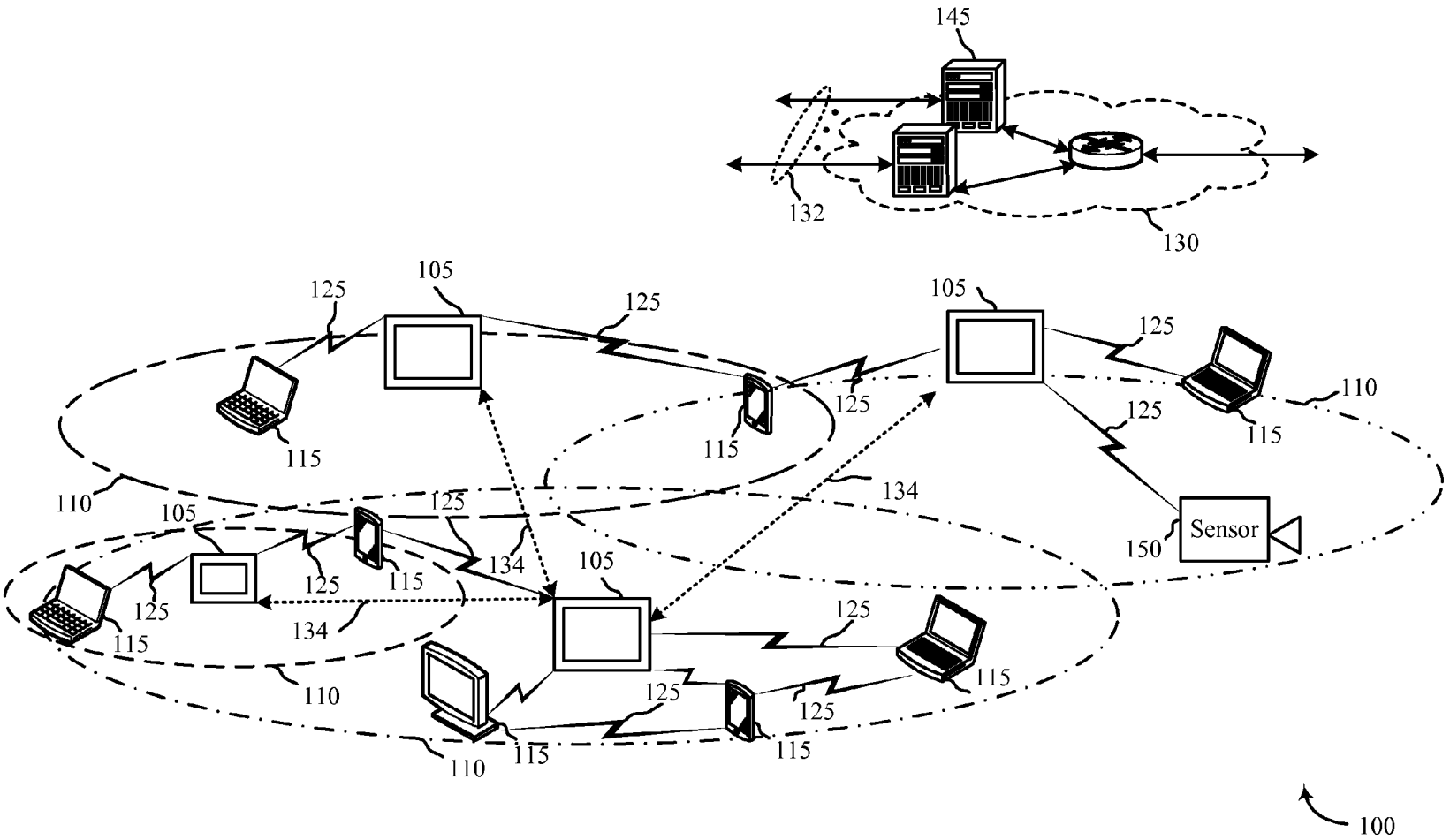
FIG. 1 shows a block diagram relating to a security and/or an automation system, in accordance with various aspects of this disclosure.

In some embodiments, security and/or automation systems, collectively referred to as automation systems, may allow a parent to leave their child at home and feel comfortable. The automation system may receive a notification that the parents are leaving. The parents may set a child alone state or a babysitter state. Once a state is set, the system may use settings determined by the parents to track one or more child parameters. The child parameters may include tracking visitors to a house, tracking medical parameters, a lights-out provision, a lock on restricted areas of the home, a wake up state, and the like. The automation system may additionally track the comings and goings of a child to determine if the child is out past a curfew, when the child left, when the child arrived at home, and the like. This may enable a parent to know their child has returned safely from school while a parent is away from the home.

The automation system may track the requirements of parents and may filter the parameters through an alert threshold. If the child parameters satisfy or exceed a threshold, the parents may receive an immediate notification. If the child parameters do not satisfy an alert threshold, the automation system may record the events and send a summary report to the parents on a predetermined basis. For example, parents may wish to receive alerts every half day, every day, or the like.

Additionally, parents may wish to know that certain events have occurred. For example, parents may want to know that children went to bed on time, left for school on time, obeyed curfew, and the like. The automation system may track the specific parameters requested by parents and immediately updates parents on the status. For example, a parent may receive an alert that the child was put to bed at a certain time. Additionally, the parent may receive an alert that the child has not been put to bed by a predetermined bed time. In other embodiments, parents may receive a notification that a child has left for the school day by the required time. Likewise, parents may receive a notification that the child has returned from school during a predetermine time range. The automation system may track the comings and goings of a child and alert the parent if a child is or is not home by a predetermined time. This may allow a parent to feel comfortable leaving a child at home knowing they are receiving updates. Additionally, a child may be more likely to conform to parental required behavior if they are aware of being tracked. For example, a child may be less likely to throw a party if the liquor cabinet is locked and parents are receiving images of people that come to the door or enter the premises.

In some embodiments, the automation system may track the behaviors of the child to determine an identity of the child. This may enable the automation system to confirm the occurrence, or lack of, an event and alert a parent as such. While the terms parent and children may be used through the application, the term parent may include any authoritative figure, adult, or the like. Likewise, the term child or children may encompass not only minors, but any person under supervision regardless of age.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

FIG. 1 illustrates an example of a communications system 100 in accordance with various aspects of the disclosure. The communications system 100 may include control panels 105, devices 115, a network 130, and/or sensors 150. The network 130 may provide user authentication, encryption, access authorization, tracking, Internet Protocol (IP) connectivity, and other access, calculation, modification, and/or functions. The control panels 105 may interface with the network 130 through a first set of wired and/or wireless communication links 132 to communicate with one or more remote servers 145. The control panels 105 may perform communication configuration, adjustment, and/or scheduling for communication with the devices 115, or may operate under the control of a controller. In various examples, the control panels 105 may communicate—either directly or indirectly (e.g., through network 130)—with each other over a second set of wired and/or wireless communication links 134. Control panels 105 may communicate with a back end server (such as the remote servers 145)—directly and/or indirectly—using the first set of one or more communication links 132.

The control panels 105 may wirelessly communicate with the devices 115 via one or more antennas. Each of the control panels 105 may provide communication coverage for a respective geographic coverage area 110. In some examples, control panels 105 may be referred to as a control device, a base transceiver station, a radio base station, an access point, a radio transceiver, or some other suitable terminology. The geographic coverage area 110 for a control panel 105 may be divided into sectors making up only a portion of the coverage area. The communications system 100 may include control panels 105 of different types. There may be overlapping geographic coverage areas 110 for one or more different parameters, including different technologies, features, subscriber preferences, hardware, software, technology, and/or methods. For example, each control panel 105 may be related to one or more discrete structures (e.g., a home, a business) and each of the one more discrete structures may be related to one or more discrete areas. In other examples, multiple control panels 105 may be related to the same one or more discrete structures (e.g., multiple control panels relating to a home and/or a business complex).

The devices 115 may be dispersed throughout the communications system 100 and each device 115 may be stationary and/or mobile. A device 115 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a camera, and/or the like. A device 115 may also include or be referred to by those skilled in the art as a user device, a smartphone, a BLUETOOTH® device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

The control panels 105 may wirelessly communicate with the sensors 150 via one or more antennas. The sensors 150 may be dispersed throughout the communications system 100 and each sensor 150 may be stationary and/or mobile. A sensor 150 may include and/or be one or more sensors that sense: proximity, motion, temperatures, humidity, sound level, smoke, structural features (e.g., glass breaking, window position, door position), time, light geo-location data of a user and/or a device, distance, biometrics, weight, speed, height, size, preferences, light, darkness, weather, time, system performance, and/or other inputs that relate to a security and/or an automation system. A device 115 and/or a sensor 150 may be able to communicate through one or more wired and/or wireless connections with various components such as control panels, base stations, and/or network equipment (e.g., servers, wireless communication points, etc.) and/or the like.

The communication links 125 shown in communications system 100 may include uplink (UL) transmissions from a device 115 to a control panel 105, and/or downlink (DL) transmissions, from a control panel 105 to a device 115. The downlink transmissions may also be called forward link transmissions while the uplink transmissions may also be called reverse link transmissions. Each communication link 125 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 125 may transmit bidirectional communications and/or unidirectional communications. Communication links 125 may include one or more connections, including but not limited to, 345 MHz, Wi-Fi, BLUETOOTH®, BLUETOOTH® Low Energy, cellular, Z-WAVE®, 802.11, peer-to-peer, LAN, WLAN, Ethernet, fire wire, fiber optic, and/or other connection types related to security and/or automation systems.

In some embodiments, of communications system 100, control panels 105 and/or devices 115 may include one or more antennas for employing antenna diversity schemes to improve communication quality and reliability between control panels 105 and devices 115. Additionally or alternatively, control panels 105 and/or devices 115 may employ multiple-input, multiple-output (MIMO) techniques that may take advantage of multi-path, mesh-type environments to transmit multiple spatial layers carrying the same or different coded data.

While the devices 115 may communicate with each other through the control panel 105 using communication links 125, each device 115 may also communicate directly with one or more other devices via one or more direct communication links 134. Two or more devices 115 may communicate via a direct communication link 134 when both devices 115 are in the geographic coverage area 110 or when one or neither devices 115 is within the geographic coverage area 110. Examples of direct communication links 134 may include Wi-Fi Direct, BLUETOOTH®, wired, and/or, and other P2P group connections. The devices 115 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within communications system 100.

The sensors 150 may be proximate an entry to a residence and may comprise smart sensors. For example, the sensors 150 may detect when a door has been opened from the inside or outside of the residence. The sensors 150 may additionally detect the presence of a person passing through the door and the direction the person was heading. If a person is heading inside the residence, the sensors 150 may activate other sensors to track behavioral patterns of the person. Likewise, one or more sensors 150 may receive a notification based on a time of day to begin tracking behavioral patterns of a person. The time of day may be based on the prediction of the person's pending departure from the residence.

Likewise, other sensors 150 may additionally activate based on a state of the alarm system. For example, if a parent left a child at home either alone or with a babysitter, the automation system may activate one or more sensors 150 to track the overall progress of the child. The sensors 150 may track television habits, bedtime habits, personal hygiene habits (i.e. showering, teeth brushing, and the like).

Additionally, one or more devices 115 may activate to protect select areas of a home when a child is left home alone or with reduced supervision. The devices 115 may lock down select areas of the home or may offer alerts or alarms when select areas of the home are breached. For example, the devices 115 may ensure a firearm safe is unable to be opened, a liquor cabinet is locked, a home office is locked, an alert is issued when an attic door opens, an alert is issued if an automobile leaves the premises, and the like. Each residence may have unique circumstances which the parent may be able to protect through the use of the devices 115 and/or sensors 150.

Figure 2:
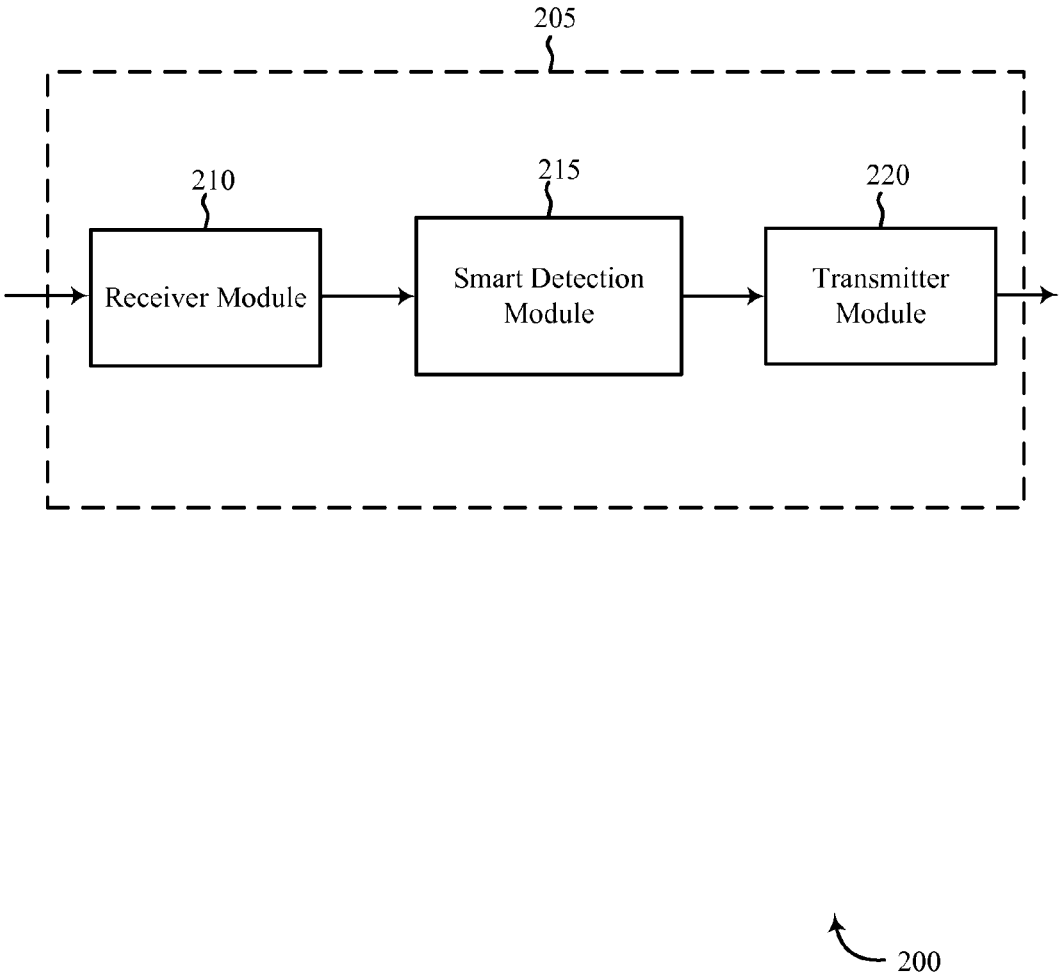
FIG. 2 shows a block diagram of a device relating to a security and/or an automation system, in accordance with various aspects of this disclosure.

FIG. 2 shows a block diagram 200 of a control panel 205 for use in electronic communication, in accordance with various aspects of this disclosure. The control panel 205 may be an example of one or more aspects of a control panel 105 described with reference to FIG. 1. The control panel 205 may include a receiver module 210, a smart detection module 215, and/or a transmitter module 220. The control panel 205 may also be or include a processor. Each of these modules may be in communication with each other—directly and/or indirectly.

The components of the control panel 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive notification of a person entering and/or exiting a home, behaviors taken prior to or after the person arrives/departs, and the like. Information may be passed on to the smart detection module 215, and to other components of the control panel 205.

The smart detection module 215 may be programmed to smartly detect when an identifiable person has exited or entered a residence based on their behavioral patterns either prior to departing or after arriving. The smart detection module 215 may be equipped with different user profiles which may have behavioral patterns of one or more users of an automation system. The smart detection module 215 may queue a recognition pattern at a set time or upon a certain event. For example, the smart detection module 215 may begin to track the behaviors of a person at a select time in the morning. As the smart detection module 215 records specific actions, the smart detection module 215 may compare the sequence or actions, or totality of actions, to user profiles to determine an identity of the person. Depending on the identity, the person may be expected to leave the house by a select time. The time may be a factor of a parental concern, or may be a factor of arriving to a location on time. For example, a parent may want a child to be punctual for the beginning of school. Therefore, once an identity is known, if it is a child, the smart detection module 215 may alert the child to leave within a predetermined time period. Additionally, the smart detection module 215 may record when the child actually left and transmit this information to a parent. This may enable a working parent, or simply a busy parent, to be aware of the child's whereabouts and compliance, or lack thereof, with behavioral expectations.

Likewise, the smart detection module 215 may begin to detect behavior and actions of a person after a person had entered the residence. The smart detection module 215 may compare the actions, series of actions, and/or group of actions to a series of user profiles to affirmatively identify the person. The person may be a child and the smart detection module 215 may expect the child to arrive home between a predetermined time range. The smart detection module 215, upon affirmatively identifying the child, may alert a parent of the child's arrival in the home. This may ensure the parent that the child has arrived home safely after school, after an activity, or after any absence from the home. The predetermined time range may be determined by the parent and may allow the parent to determine if their child is acting within the behavioral expectations set forth. For example, if a child arrives home after the predetermined time range after school, the parent may suspect the child engaged in unsanctioned extra-curricular activities after school.

The transmitter module 220 may transmit the one or more signals received from other components of the control panel 205. The transmitter module 220 may transmit information collected by sensors such as actions or behaviors, times of entry, and the like. In some examples, the transmitter module 220 may be collocated with the receiver module 210 in a transceiver module.

Figure 3:
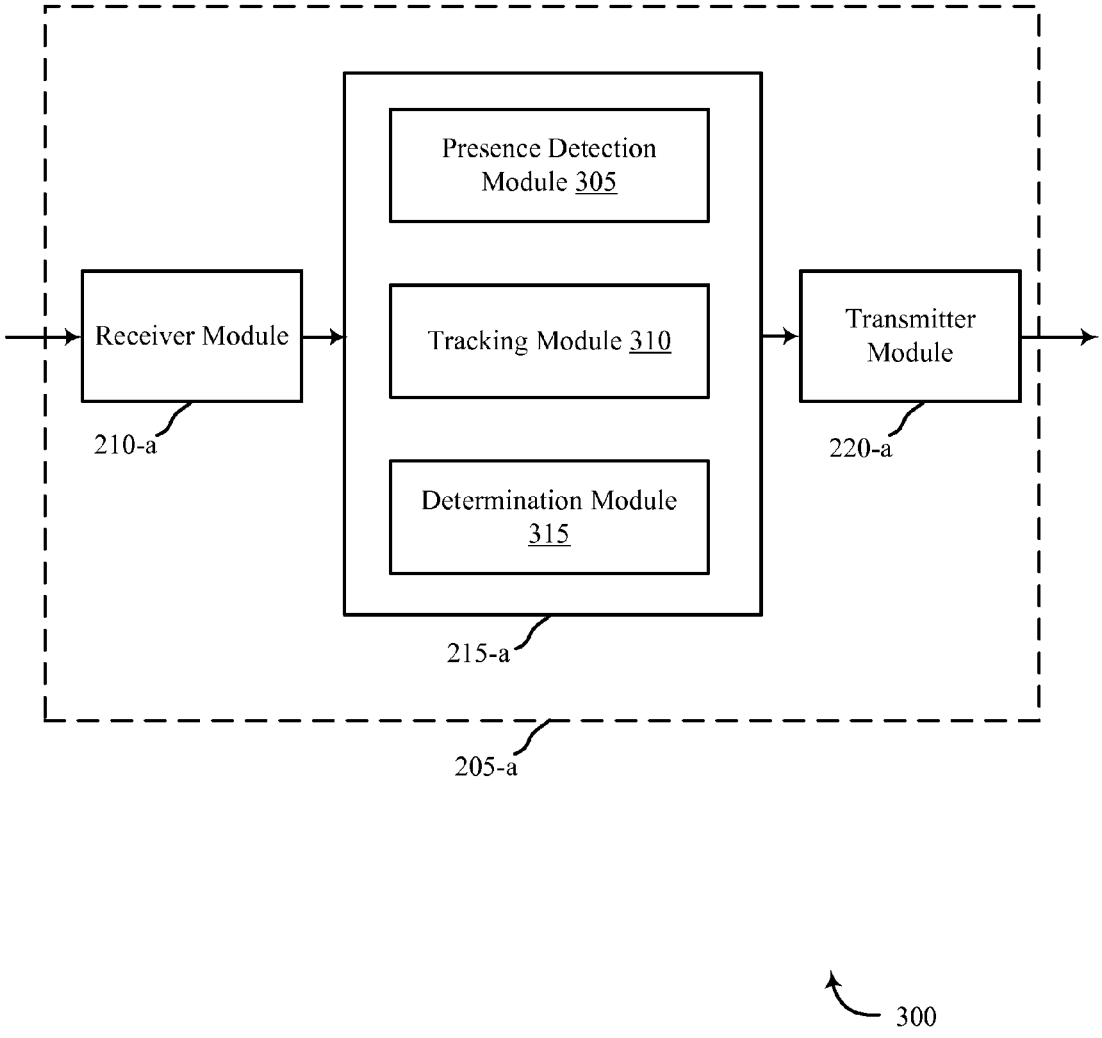
FIG. 3 shows a block diagram of a device relating to a security and/or an automation system, in accordance with various aspects of this disclosure.

FIG. 3 shows a block diagram 300 of a control panel 205-*a* for use in wireless communication, in accordance with various examples. The control panel 205-*a* may be an example of one or more aspects of a control panel 105 described with reference to FIGS. 1 and/or 2. It may also be an example of a control panel 205 described with reference to FIG. 2. The control panel 205-*a* may include a receiver module 210-*a*, a smart detection module 215-*a*, and/or a transmitter module 220-*a*, which may be examples of the corresponding modules of control panel 205. The control panel 205-*a* may also include a processor. Each of these components may be in communication with each other. The smart detection module 215-*a* may include a presence detection module 305, a tracking module 310, and a determination module 315. The receiver module 210-*a* and the transmitter module 220-*a* may perform the functions of the receiver module 210 and the transmitter module 220, of FIG. 2, respectively.

The components of the control panel 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The presence detection module 305 may detect the presence of a person in the household. The presence may be detected by select actions performed in the house, or by detecting an empty house and a person entering the house. For example, the presence detection module 305 may be linked to a door sensor which may detect when a door to a residence is opened and when a person enters the house. The person may be the sole occupant of the house, or may join other occupants currently present in the residence. The presence detection module 305 may also detect when a person exits a home. The presence detection module 305 may use the smart door sensor to detect when the door is opened and consequently when a person or people leave the home.

The presence detection module 305 may detect the presence of multiple people in the home and may be able to differentiate between which people are performing which actions. The presence detection module 305 may use known behaviors to detect multiple people, may use cameras, heat sensing sensors, footstep detectors, and the like to determine the presence of multiple people.

The tracking module 310 may track the actions of one or more people in the residence. The tracking module 310 may normally track actions, or may be prompted to record the activities of the residence's occupants. If the tracking module 310 is prompted, the prompting may be caused by several scenarios. For example, the tracking module 310 may track the behavior and actions of a person who has recently entered a residence. The tracking module 310 may track the actions and behaviors for a predetermined time period. Or, in some embodiments, the tracking module 310 may track the behaviors until the determination module 315 has enough information to identify the person.

The tracking module 310 may also begin tracking the actions of a person or persons beginning at a select time of day. For example, the tracking module 310 may begin to track a person during the morning to determine the identity of a person before the person exits the residence. The tracking module 310 may begin at a predetermined time every day or may use a calendar function to determine when to being tracking the actions of people.

Additionally, the tracking module 310 may track behavior to determine conformance to expected behaviors and actions. If a child is left home alone, or if a babysitter is watching the children, parents may wish to know that their child is conforming or not conforming to expected behavioral standards. The tracking module 310 may track the actions and activities of the home's occupants to determine which actions are being taken. If any actions cross a threshold into an unacceptable action or activity, the tracking module 310 may issue an alert to a parent or other administrator.

The determination module 315 may determine an identity of a person in the home, may determine if thresholds have been satisfied or surpassed, and the like. The determination module 315 may review the actions collected by the tracking module 310, either in sequence or in total, and compare the actions to user profiles. The user profiles may include the habits of a person prior to exiting a residence or after returning to a residence. The habits of a person may allow the determination module 315 to positively identify the person prior to exiting or after entering a residence. If the person is a minor or a child, the determination module 315 may send a message to a parent alerting them that a child is preparing to leave and/or has left the residence, or conversely, that a child has arrived to the residence. This may allow the determination module 315 to provide a peace of mind to a parent knowing that their child left in time for school or has arrived home safely after school. The determination module 315 may additionally send alerts which may include when a person has accompanied the child into the home and the like. In some embodiments, the determination module 315 may query the parent to determine if the parent wants to change a security setting at the residence based on the arrival and/or departure of the person.

In some embodiments, the parent may wish for a security setting unique to an unsupervised child be set. The security setting may limit the child's access to features of the home, provide more frequent alerts to a parent, and the like. For example, the security setting may lock an office door, lock a liquor cabinet, lock a master bedroom, activate security cameras, activate a doorbell camera, and the like. The security setting may send more frequent alerts and/or updates to the parent. The more frequent alerts and/or updates may provide assurances to the parent that their child is home and safe. The security setting may additionally track any comings and goings to the residence to continually monitor the safety. For example, the security setting may notify the parent if the child exits the home, if the child exited the home alone or was accompanied by another person or a family pet. The security setting may notify the parent if the child left through a back or front door, if the child has exited a perimeter of the house, and the like. The security setting may default to select parental settings but may also be customized to a particular home and family situation.

Figure 4:
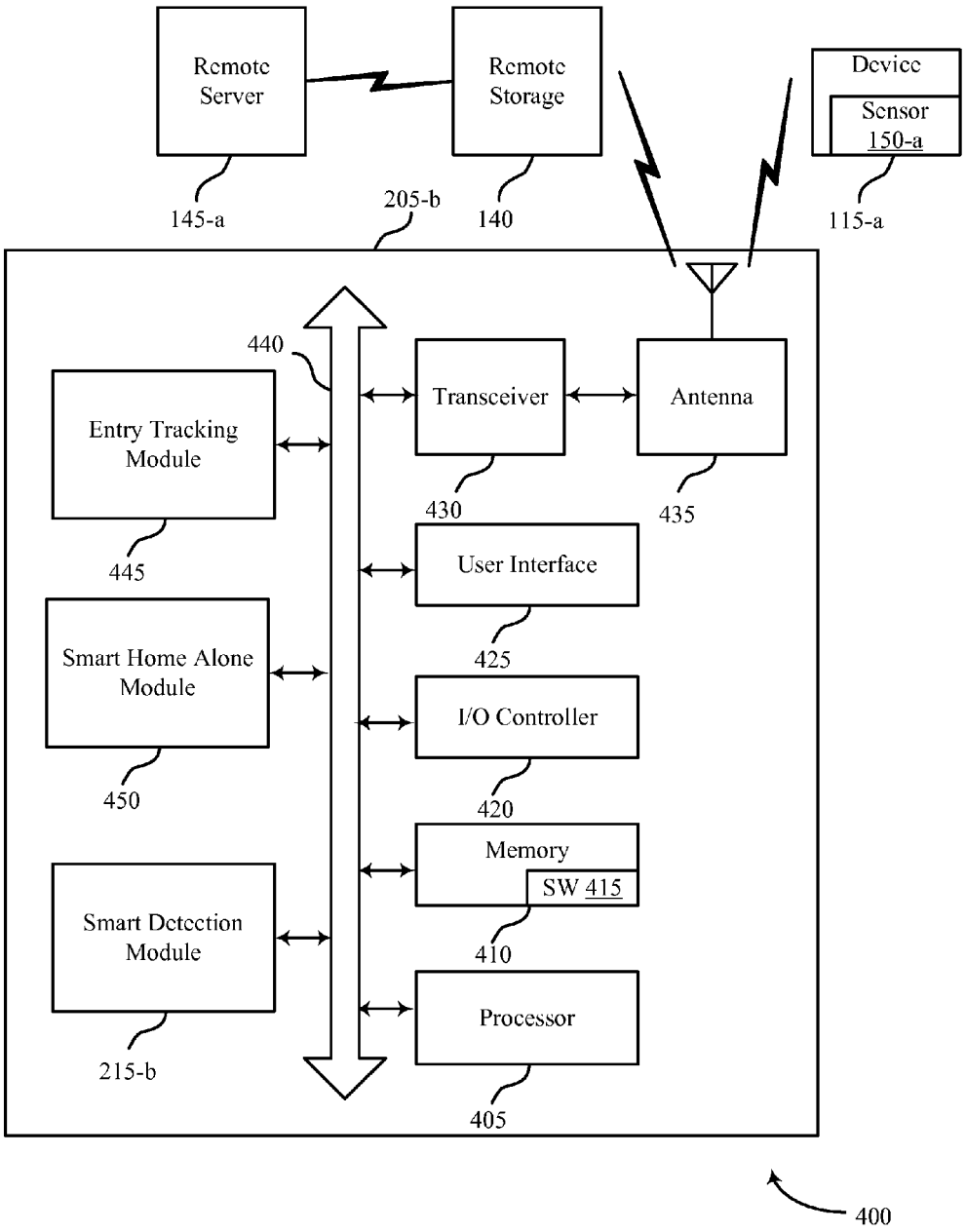
FIG. 4 shows a block diagram relating to a security and/or an automation system, in accordance with various aspects of this disclosure.

FIG. 4 shows a system 400 for use in smart detection systems, in accordance with various examples. System 400 may include a control panel 205-*b*, which may be an example of the control panels 105 of FIG. 1. Control panel 205-*b* may also be an example of one or more aspects of control panels 205 and/or 205-*a* of FIGS. 2 and 3.

Control panel 205-*b* may include an entry tracking module 445 and a smart home alone module 450. Additionally, control panel 205-*b* may include a smart detection module 215-*b*, which may be an example of smart detection module 215 described with reference to FIGS. 2 and/or 3. In some embodiments, the terms a control panel and a control device are used synonymously.

Control panel 205-*b* may also include components for bi-directional voice and data communications including components for transmitting communications and components for receiving communications. For example, control panel 205-*b* may communicate bi-directionally with one or more of device 115-*a*, one or more sensors 150-*a*, remote storage 140, and/or remote server 145-*a*, which may be an example of the remote server 145 of FIG. 1. This bi-directional communication may be direct (e.g., control panel 205-*b* communicating directly with remote storage 140) or indirect (e.g., control panel 205-*b* communicating indirectly with remote server 145-*a* through remote storage 140).

The entry tracking module 445 may track the occurrences at an entry to a home based at least in part on entry parameters. For example, the entry tracking module 445 may track when people arrive at a door from an external part of a residence, walk to the door from an internal part of the residence, when a door is opened, where the door opening originated from (i.e. inside or outside the home), if a person(s) passed through the door and in which direction (i.e. entering or exiting the home), and the like. The entry tracking module 445 may use several sensors 150-*a* to track the events that occur at a door. For example, the entry tracking module 445 may track when a person approached the door from the outside of the home but did or did not ring the doorbell. The entry tracking module 445 may determine if the person left a package, was wearing an official uniform, or if the person was out of the normal. The entry tracking module 445 may determine if a person left the house carrying certain items such as a backpack. The entry tracking module 445 may also determine if a person left carrying larger objects, such as a couch or television.

The smart home alone module 450 may activate a security setting based at least in part on a status of the home and/or requested input from a user of the automation system. For example, the smart home alone module 450 may activate alarm thresholds and parameters associated with a child either being home alone or being left with a non-parental care giver. The smart home alone module 450 may provide additional alerts to a parent associated with the child being without an adult and may provide assurances to a parent that their child is safe and provide updates which may display their child acting within expected behavioral considerations. The smart home alone module 450 may also provide additional security measures in consideration of the child being home alone. This may include a reduced threshold for select alarms.

Control panel 205-*b* may also include a processor module 405, and memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of device 115-*a*, remote storage 140, and/or remote server 145-*a*. The transceiver module 430 may include a modem to modulate the packets and provide the modulated packets to the one or more antennas 435 for transmission, and to demodulate packets received from the one or more antenna 435. While a control panel or a control device (e.g., 205-*b*) may include a single antenna 435, the control panel or the control device may also have multiple antennas 435 capable of concurrently transmitting or receiving multiple wired and/or wireless transmissions. In some embodiments, one element of control panel 205-*b* (e.g., one or more antennas 435, transceiver module 430, etc.) may provide a direct connection to a remote server 145-*a* via a direct network link to the Internet via a POP (point of presence). In some embodiments, one element of control panel 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensors 150-*a* (e.g., motion, proximity, smoke, light, glass break, door, window, carbon monoxide, and/or another sensor) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of control panel 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., track motion throughout a residence, detect person(s) entering or exiting a home, activate security settings, etc.). Alternatively, the software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, the smart detection module 215-*b*, entry tracking module 445, and/or the smart home alone module 450 to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to one or may be included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the control panel or control device (e.g., 205-*b*) may include a single antenna 435, the control panel or control device (e.g., 205-*b*) may have multiple antennas 435 capable of concurrently transmitting and/or receiving multiple wireless transmissions.

The control panel 205-*b* may include a smart detection module 215-*b*, which may perform the functions described above for the smart detection module 215 of control panel 205 of FIGS. 2 and 3.

Figure 5:
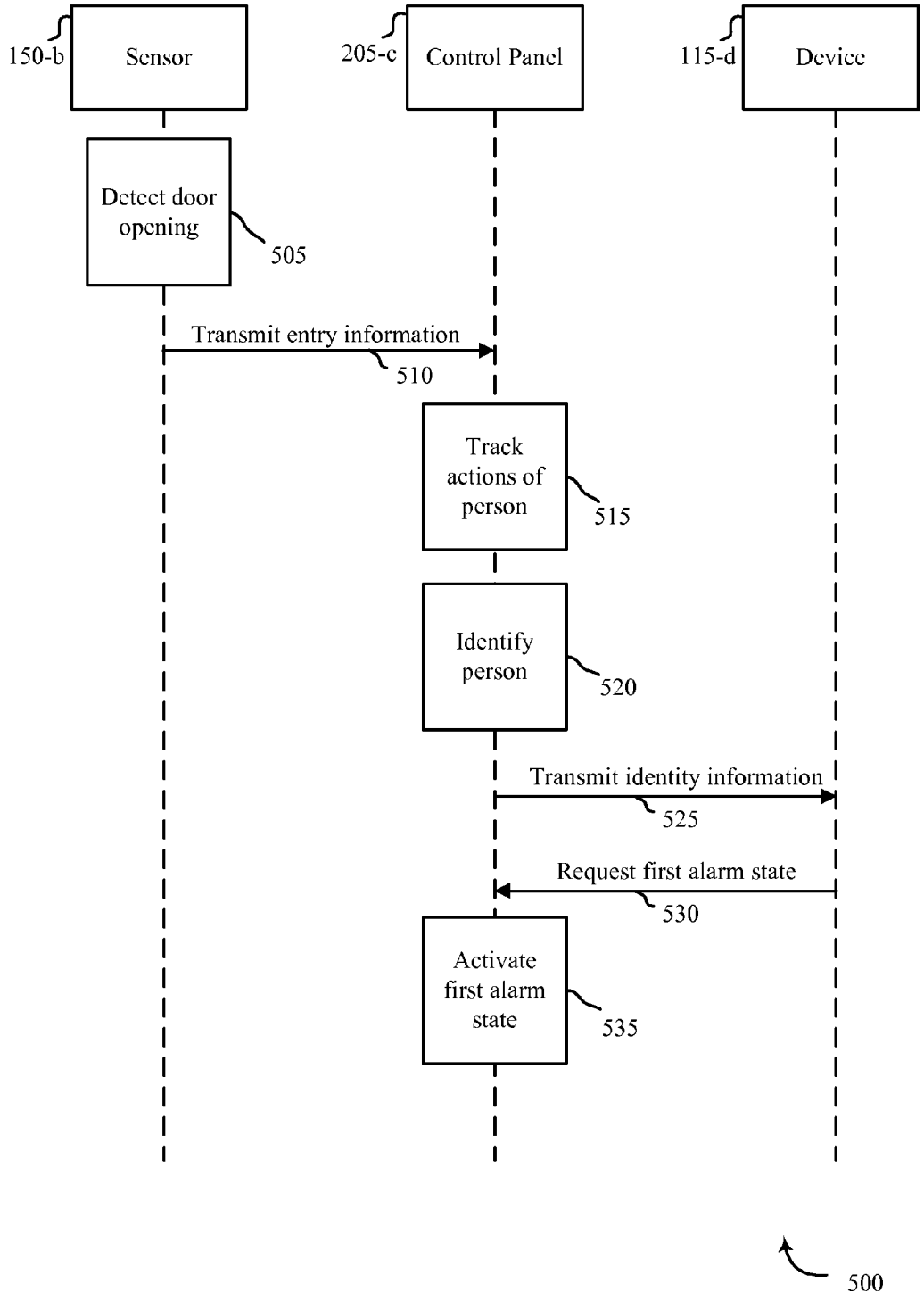
FIG. 5 shows a swim diagram of an apparatus relating to a security and/or an automation system, in accordance with various aspects of this disclosure

FIG. 5 shows a swim diagram for use in smart detection systems, in accordance with various examples. The system 500 may include a control panel 205-*c*, which may be an example of the control panel 105 of FIG. 1. Control panel 205-*b* may also be an example of one or more aspects of control panels 205 and/or 205-*a* of FIGS. 2 and 3. The system 500 may additionally include a sensor 150-*b*, which may be an example of the sensor 150 in FIGS. 1 and/or 4. The system 500 may include a device 115-*b* which may be one example of a device 115 as described with reference to FIGS. 1 and/or 4. In this embodiment, the device 115-*b* may be a user device.

The sensor 150-*b*, which may be proximate an entry to the residence, may detect a door opening 505. The sensor 150-*b* may transmit the opening information to a control panel 205-*c*. Additionally, if a person passes through the door, the sensor 150-*b* may transmit entry information 510 to the control panel 205-*c*. The control panel 205-*c* may track the actions of the person 515. The control panel 205-*c* may then compare the tracked actions to a series of user profiles to identify the person 520. The control panel 205-*c* may transmit the identity information 525 to a user via a device 115-*d*. The user, if a parent, may request a first alarm state 530 be activated in the residence. Upon receiving the request, the control panel 205-*c* may activate the first alarm state 535.

Figure 6:
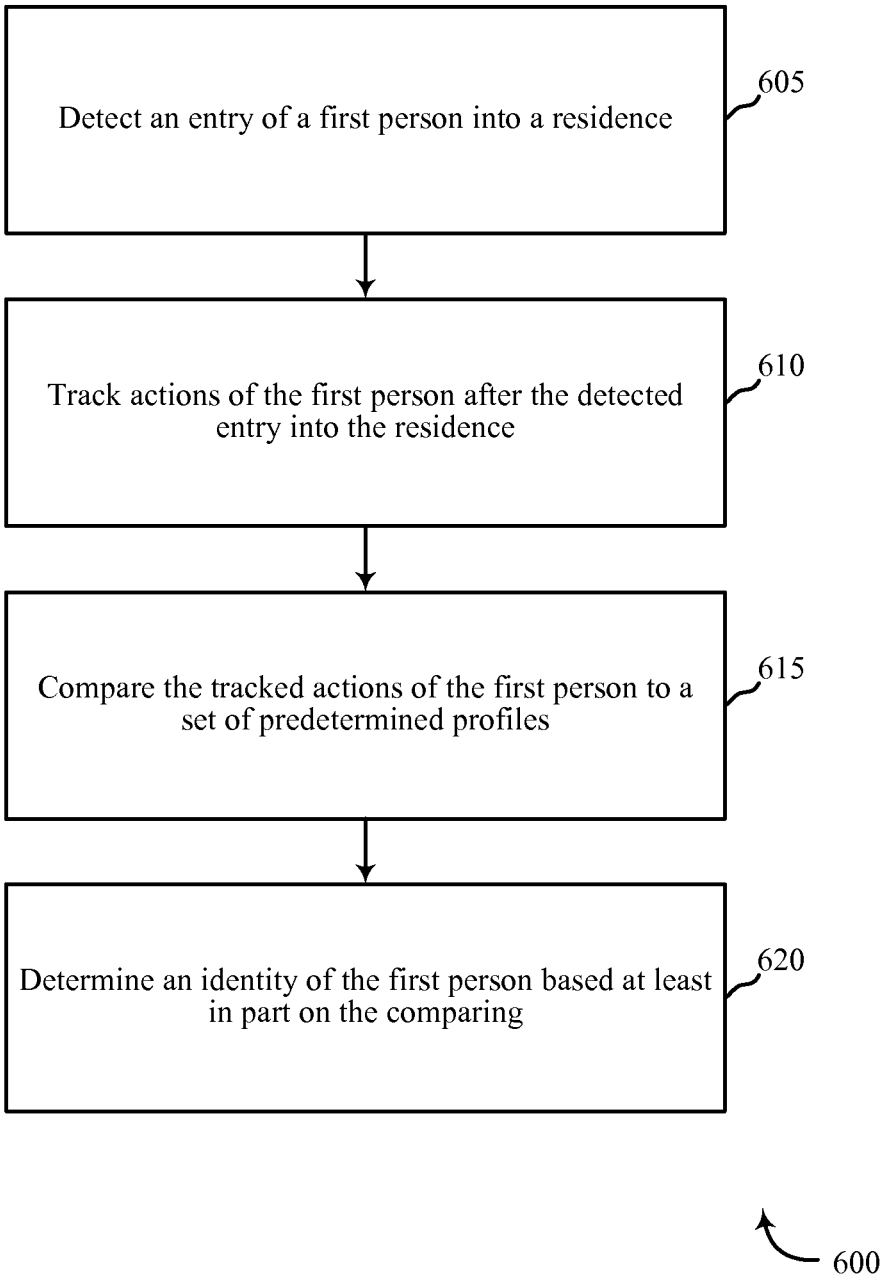
FIG. 6 is a flow chart illustrating an example of a method relating to a security and/or an automation system, in accordance with various aspects of this disclosure.

FIG. 6 is a flow chart illustrating an example of a method 600 for smart detections, in accordance with various aspects of the present disclosure. For clarity, the method 600 is described below with reference to aspects of one or more of the smart detection module 215 described with reference to FIGS. 2-4. In some examples, a control panel, backend server, and/or sensor may execute one or more sets of codes to control the functional elements of the automation system to perform the functions described below. Additionally or alternatively, the control panel, backend server, and/or sensor may perform one or more of the functions described below using special-purpose hardware.

At block 605, the method 600 may include detecting an entry of a first person into a residence. The method 600 may detect when a door to the residence is opened and when a person passes from the exterior of the home into the interior of the home. The method 600 may detect a single person, or may detect multiple people. Additionally, the method 600 may detect if the person unlocked the door upon entry, or was allowed entry by a person internal to the residence.

The operation(s) at block 605 may be performed using the presence detection module 305 described with reference to FIG. 3.

At block 610, the method 600 may include tracking actions of the first person after the detected entry into the residence. The actions may include the particular steps taken by a person upon entering a home. For example, each person may have individual habits they practice when they enter a house. One person may drop their belongings, get a drink, and sit outside. Another person may put away their belongings, set an alarm code, and change clothes. Each habitual pattern is likely to be different based on the person, time of day, and the like. The habitual pattern may also change in length depending upon the person. In some instances, the patterns may deviate but the overall pattern may remain substantially the same.

The operation(s) at block 610 may be performed using the tracking module 310 described with reference to FIG. 3.

At block 615, the method 600 may include comparing the tracked actions of the first person to a set of predetermined profiles. As mentioned, the user profile may include a series of activities which a person partakes in prior to exiting the home. The series of activities may be a sequential series of activities, or an overall cumulative activity log that occurs. At block 620, the method 600 may include determining an identity of the first person based at least in part on the comparing. For example, if the tracked actions match a profile, the method 600 may determine the identity of the person based on the match. The tracked actions may not be a complete match but a substantial portion of the actions might be equivalent for a positive identification.

Thus, the method 600 may provide for smart detection systems relating to automation/security systems. It should be noted that the method 600 is just one implementation and that the operations of the method 600 may be rearranged or otherwise modified such that other implementations are possible.

Figure 7:
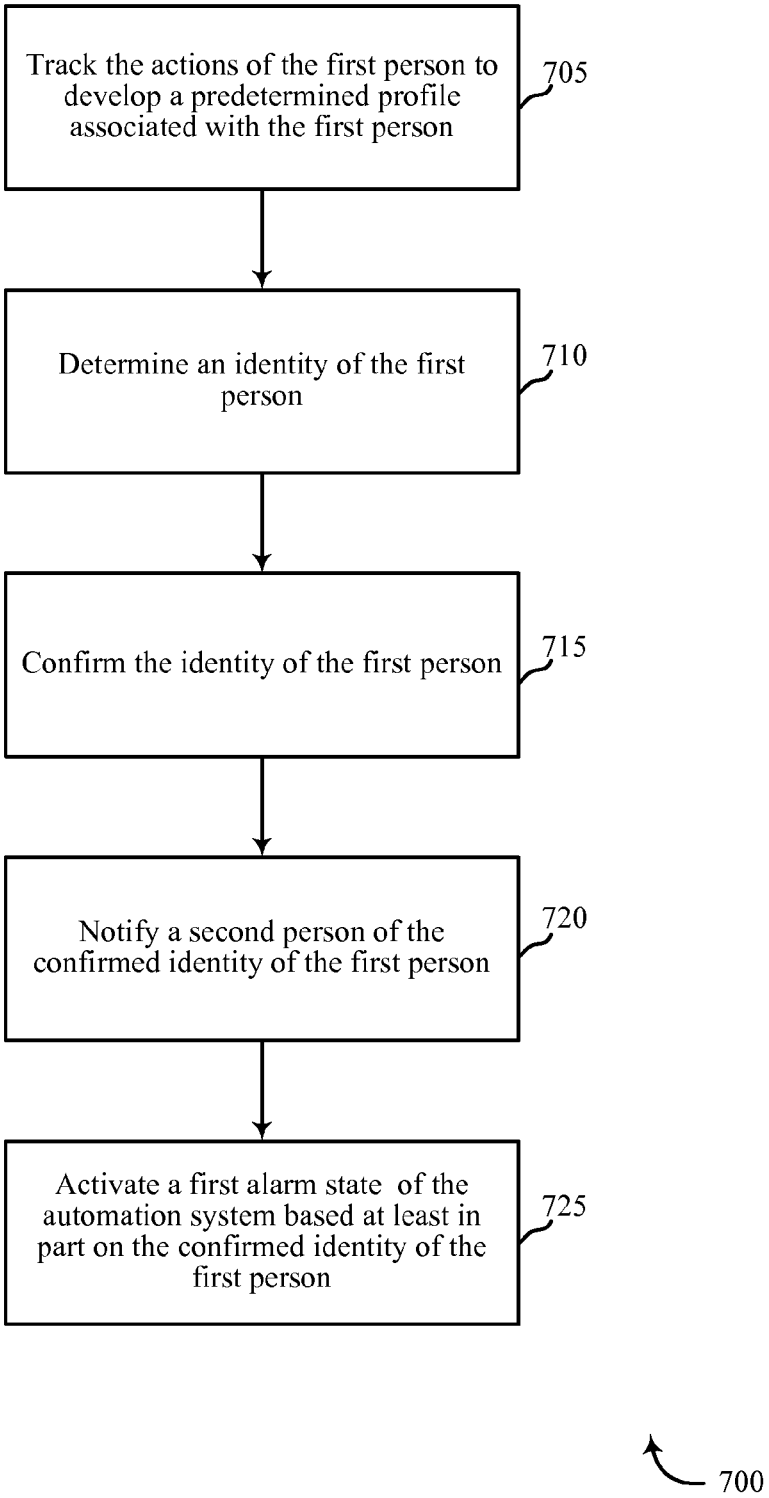
FIG. 7 is a flow chart illustrating an example of a method relating to a security and/or an automation system, in accordance with various aspects of this disclosure.

FIG. 7 is a flow chart illustrating an example of a method 700 for smart detections, in accordance with various aspects of the present disclosure. For clarity, the method 700 is described below with reference to aspects of one or more of the smart detection module 215 described with reference to FIGS. 2-4. In some examples, a control panel, backend server, and/or sensor may execute one or more sets of codes to control the functional elements of the automation system to perform the functions described below. Additionally or alternatively, the control panel, backend server, and/or sensor may perform one or more of the functions described below using special-purpose hardware.

At block 705, the method 700 may include tracking the actions of the first person to develop a predetermined profile associated with the first person. The tracked actions may be in relation to specific times of day. For example, it may be tracked actions prior to departing the home, tracked actions upon entry to a home, tracked actions before bedtime or after arising, and the like. The tracked actions may be specific to a particular user and may be used to identify a person through their actions. Therefore the predetermined profiles may not only be based on the person but may also be specific to a time of day or a specific event. For example, a person getting ready for work may perform different actions than a person preparing to leave before a sporting event, shopping trip, or the like.

The operation(s) at block 705 may be performed using the tracking module 310 described with reference to FIG. 3.

At block 710, the method 700 may include determining an identity of the first person. The confirmation may include steps outlined in block 610 as described with reference to FIG. 6. At block, 715, the method 700 may include confirming the identity of the first person. The method 700 may confirm the identity by using a biometric feature, a unique mobile device detection, unique entry, or some combination thereof. For example, the method 700 may determine the identity of the person using facial recognition, voice recognition, fingerprinting, or the like. The method 700 may additionally detect a mobile device associated with the person and compare the mobile device unique code to a user profile and determine if the codes match. This may provide a positive identification for the first person. If the person used an entry code to enter the residence, the entry code may be linked to a user profile.

At block 720, the method 700 may include notifying a second person of the confirmed identity of the first person. For example, a parent may wish to know their child arrived safely at home and may wish for a positive notification that their child is in the residence. The method 700 may additionally notify the parent if an unknown or non-identified person has entered the home. If the method 700 has positively identified a user of the automation system, at block 725, the method 700 may include activating a first alarm state of the automation system based at least in part on the confirmed identity of the first person. The first alarm state may relate to the identity. For example, if the first person is a minor child, the method 700 may activate a smart home alone alarm state to provide additional securities and protections for the child.

The operation(s) at blocks 710, 715, 720, 725 may be performed using the determination module 315 described with reference to FIG. 3.

Thus, the method 700 may provide smart detection systems relating to automation/security systems. It should be noted that the method 700 is just one implementation and that the operations of the method 700 may be rearranged or otherwise modified such that other implementations are possible.

Figure 8:
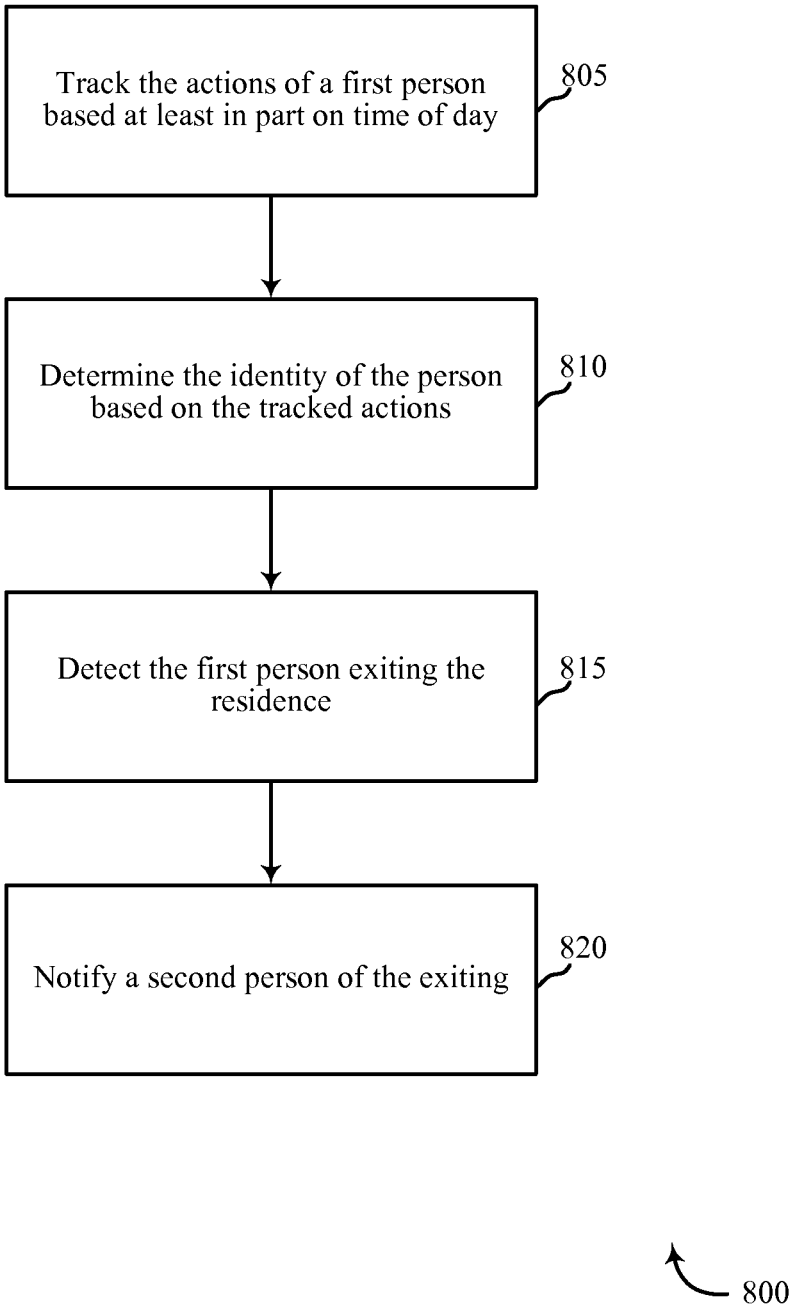
FIG. 8 is a flow chart illustrating an example of a method relating to a security and/or an automation system, in accordance with various aspects of this disclosure.

FIG. 8 is a flow chart illustrating an example of a method 800 for smart detections, in accordance with various aspects of the present disclosure. For clarity, the method 800 is described below with reference to aspects of one or more of the smart detection module 215 described with reference to FIGS. 2-4. In some examples, a control panel, backend server, and/or sensor may execute one or more sets of codes to control the functional elements of the automation system to perform the functions described below. Additionally or alternatively, the control panel, backend server, and/or sensor may perform one or more of the functions described below using special-purpose hardware.

At block 805, the method 800 may track the actions of a first person based at least in part on time of day. This may include tracking the actions of the first person prior to when the first person is set to leave the house. The pattern of behavior for the person may be different based on time of day. If a morning time frame, the person may eat breakfast, clean-up, and the like. If the tracking begins at a different time frame, the actions and activities may be different. Additionally, the actions and activities may be different based at least in part on the actual person.

The operation(s) at block 805 may be performed using the tracking module 310 described with reference to FIG. 3.

At block 810, the method 800 may include determining the identity of the person based on the tracked actions. As discussed previously, the tracked actions may be compared to user profiles to positively identify the person. At block 815, the method 800 may include detecting the first person exiting the residence. The method 800 may work in conjunction with a smart door sensor which may detect the door opening from the inside and a person passing from the inside of the residence to the outside of the residence. The method 800 may determine the person has exited the residence when the first person does not reenter the residence within a predetermined time period.

The operation(s) at block 810 may be performed using the determination module 315 described with reference to FIG. 3. The operation(s) at block 815 may be performed using the presence detection module 305 described with reference to FIG. 3.

At block 820, the method 800 may include notifying a second person of the exiting. If the first person is expected to leave the house to be punctual for the start of school, a parent may receive a notification that the child left the house in a timely fashion. This may allow a parent peace of mind in knowing their child should arrive on time for school. Additionally, if the child is at home and not expected to leave, the parent may wish to know that a child has exited the residence. This may allow a parent take additional action if necessary to follow up with their child.

The operation(s) at block 820 may be performed using the determination module 315 described with reference to FIG. 3.

Thus, the method 800 may provide smart detection systems relating to automation/security systems. It should be noted that the method 800 is just one implementation and that the operations of the method 800 may be rearranged or otherwise modified such that other implementations are possible.

In some examples, aspects from two or more of the methods 600, 700, 800 may be combined and/or separated. It should be noted that the methods 600, 700, 800 are just example implementations, and that the operations of the methods 600, 700, 800 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, comprising:

receiving, via a control panel of a residence, a first and second set of sensor data from at least one sensor;

detecting, via the control panel, an entry of a first person into the residence based at least in part on the first set of sensor data;

determining, via the control panel, that the residence is unoccupied prior to the entry of the first person based at least in part on the second set of sensor data;

tracking, via the control panel, actions of the first person after the detected entry to the residence;

comparing, via the control panel, the tracked actions of the first person to a set of predetermined profiles of persons associated with the residence;

determining, via the control panel, an identity of the first person based at least in part on the comparing;

issuing, via the control panel, a first alert message having a first frequency to a device associated with a second person remote from the residence using a network based at least in part on the identity of the first person and the determination that the residence is unoccupied prior to the entry of the first person;

determining, via the control panel, that the tracked actions satisfy an unacceptable action threshold based at least in part on the identity of the first person; and issuing, via the control panel, a second alert message having a second frequency different from the first frequency to the device associated with the second person remote from the residence using the network based at least in part on the tracked actions satisfying the unacceptable action threshold.

2. The method of claim 1, furthering comprising:

tracking actions of the first person to develop a predetermined profile associated with the first person.

3. The method of claim 1, wherein tracking the actions of the first person is based at least in part on identifying a time associated with the entry of the first person into the residence.

4. The method of claim 1, furthering comprising:

notifying the second person of the confirmed identity of the first person;

receiving a request associated with a security setting of the automation system from a remote device of the second person based at least in part on the notifying; and activating a security setting of the automation system based at least in part on the request received from the remote device.

5. The method of claim 4, wherein the first person is a minor and the second person is an adult.

6. The method of claim 1, further comprising:

confirming an identity of the first person via at least a biometric feature, a unique mobile device detection, a unique entry code, or a combination thereof.

7. The method of claim 6, further comprising:

activating an alarm state of the automation system based at least in part on the confirmed identify of the first person.

8. The method of claim 1, furthering comprising:

detecting the first person exiting the residence; and notifying the second person of the detected exit after a predetermined time period.

9. The method of claim 8, further comprising:

detecting that the first person does not reenter the residence within the predetermined time period after exiting the residence.

10. The method of claim 1, furthering comprising:

identifying a user pattern of behavior of the first person based at least in part on time of day and the tracked actions of the first person.

11. The method of claim 10, wherein the pattern of behavior is different based at least in part on the time of day.

12. An apparatus for security and/or automation systems, comprising:

a processor of a control panel;

memory in electronic communication with the processor; and instructions stored in the memory, the instructions being executable by the processor to:

receive a first and second set of sensor data from at least one sensor;

detect an entry of a first person into a residence based at least in part on the first set of sensor data;

determine that the residence is unoccupied prior to the entry of the first person based at least in part on the second set of sensor data;

track actions of the first person after the detected entry to the residence;

compare the tracked actions of the first person to a set of predetermined profiles of persons associated with the residence;

determine an identity of the first person based at least in part on the comparing;

issue a first alert message having a first frequency to a device associated with a second person remote from the residence using a network based at least in part on the identity of the first person and the determination that the residence is unoccupied prior to the entry of the first person;

determine that the tracked actions satisfy an unacceptable action threshold based at least in part on the identity of the first person; and issue a second alert message having a second frequency different from the first frequency to the device associated with the second person remote from the residence using the network based at least in part on the tracked actions satisfying the unacceptable action threshold.

13. The apparatus of claim 12, the instructions being further executable by the processor to:

track actions of the first person and the second person to develop a predetermined profile associated with the first person and the second person.

14. The apparatus of claim 12, wherein tracking the actions of the first person and the second person is based at least in part on identifying a time associated with the entry of the first person and the second person into the residence.

15. The apparatus of claim 12, the instructions being further executable by the processor to:

confirm an identity of the first person and the second person via at least a biometric feature, a unique mobile device detection, a unique entry code, or a combination thereof.

16. A non-transitory computer-readable medium storing computer-executable code, the code executable by a processor of a control panel to:

receive a first and second set of sensor data from at least one sensor;

detect an entry of a first person into a residence based at least in part on the first set of sensor data;

determine that the residence is unoccupied prior to the entry of the first person based at least in part on the second set of sensor data;

track actions of the first person after the detected entry to the residence; compare the tracked actions of the first person to a set of predetermined profiles of persons associated with the residence;

determine an identity of the first person based at least in part on the comparing;

issue a first alert message having a first frequency to a device associated with a second person remote from the residence using a network based at least in part on the identity of the first person and the determination that the residence is unoccupied prior to the entry of the first person;

determine that the tracked actions satisfy an unacceptable action threshold based at least in part on the identity of the first person; and issue a second alert message having a second frequency different from the first frequency to the device associated with the second person remote from the residence using the network based at least in part on the tracked actions satisfying the unacceptable action threshold.

17. The non-transitory computer-readable medium of claim 16, wherein the code is further executable by the processor to:

track actions of the first person to develop a predetermined profile associated with the first person.

18. The non-transitory computer-readable medium of claim 16, wherein tracking the actions of the first person is based at least in part on identifying a time associated with the entry of the first person into the residence.

19. The non-transitory computer-readable medium of claim 16, wherein the code is further executable by the processor to:

confirm an identity of the first person via at least a biometric feature, a unique mobile device detection, a unique entry code, or a combination thereof.

20. The non-transitory computer-readable medium of claim 19, wherein the code is further executable by the processor to:

activate an alarm state of the automation system based at least in part on the confirmed identify of the first person.

21. The method of claim 1, wherein the first set of sensor data and the second set of sensor data are different.

22. The apparatus of claim 12, wherein the first set of sensor data and the second set of sensor data are different.

23. The non-transitory computer-readable medium of claim 16, wherein the first set of sensor data and the second set of sensor data are different.

* * * * *